US008469544B2

(12) United States Patent
Angelini et al.

(10) Patent No.: US 8,469,544 B2
(45) Date of Patent: Jun. 25, 2013

(54) MULTIPLE OPTICAL ASSEMBLY FOR A LED LIGHTING DEVICE, AND LED LIGHTING DEVICE COMPRISING SUCH AN OPTICAL ASSEMBLY

(75) Inventors: Marco Angelini, Via Milano (IT); Natale Baraldo, Via San Martino (IT); Claudia Bigliatti, Trino (IT); Luca Scodes, Via Mazzini (IT)

(73) Assignee: Fraen Corporation S.R.L., Via Senato (IT)

( * ) Notice: Subject to any disclaimer, the term of this patent is extended or adjusted under 35 U.S.C. 154(b) by 0 days.

(21) Appl. No.: 13/494,389

(22) Filed: Jun. 12, 2012

(65) Prior Publication Data

US 2012/0250317 A1 Oct. 4, 2012

Related U.S. Application Data

(63) Continuation of application No. 13/103,212, filed on May 9, 2011, now abandoned, which is a continuation of application No. 10/543,226, filed as application No. PCT/IT2004/000016 on Jan. 23, 2004, now Pat. No. 7,938,559.

(30) Foreign Application Priority Data

Jan. 24, 2003 (IT) ..... MI2003A0112

(51) Int. Cl.
*F21V 7/00* (2006.01)

(52) U.S. Cl.
USPC ..... 362/241; 362/240; 362/247; 362/249.02

(58) Field of Classification Search
USPC ..... 362/237, 238, 240, 241, 244, 245, 362/247, 249.02, 249.11
See application file for complete search history.

(56) References Cited

U.S. PATENT DOCUMENTS

| | | | | |
|---|---|---|---|---|
| 4,914,731 | A * | 4/1990 | Chen | 340/815.45 |
| 4,935,665 | A * | 6/1990 | Murata | 313/500 |
| 5,893,633 | A | 4/1999 | Uchio et al. | |
| 5,896,093 | A | 4/1999 | Sjobom | |
| 6,170,971 | B1 | 1/2001 | Godbillon | |
| 6,244,727 | B1 | 6/2001 | Ryan et al. | |
| 6,402,347 | B1 | 6/2002 | Maas et al. | |
| 6,473,238 | B1 | 10/2002 | Daniell | |
| 6,485,160 | B1 | 11/2002 | Sommers | |
| 6,641,284 | B2 * | 11/2003 | Stopa et al. | 362/240 |
| 2001/0028506 | A1 | 10/2001 | Fujimoto et al. | |

FOREIGN PATENT DOCUMENTS

| | | | |
|---|---|---|---|
| EP | 0640850 | A2 | 3/1995 |
| JP | 09102631 | A | 4/1997 |

OTHER PUBLICATIONS

English Abstract of Japanese Publication JP 09102631 A, Apr. 15, 1997.

* cited by examiner

*Primary Examiner* — Thomas Sember
(74) *Attorney, Agent, or Firm* — Reza Mollaaghababa; Pepper Hamilton LLP

(57) ABSTRACT

A LED light device has a number of LED's, a multiple optical assembly defined by a number of modular units; each modular unit has a total internal reflection lens associated with a LED; and the modular units are connected to one another so as the lenses have respective distinct optical reflecting surfaces.

24 Claims, 4 Drawing Sheets

MULTIPLE OPTICAL ASSEMBLY FOR A LED LIGHTING DEVICE, AND LED LIGHTING DEVICE COMPRISING SUCH AN OPTICAL ASSEMBLY

The present application is a continuation application of U.S. patent application Ser. No. 13/103,212, which is in turn a continuation application of U.S. patent application Ser. No. 10/543,226, entitled, "Multiple Optical Assembly For LED Lighting Device, And Red Lighting Device Comprising Such An Optical Assembly," filed on Aug. 16, 2006, which is the National Stage (35 U.S.C. §371) of International Application No. PCT/IT04/00016, filed Jan. 23, 2004 and titled "Multiple Optical Assembly For LED Lighting Device, And Red Lighting Device Comprising Such An Optical Assembly," which claims priority to Italian Application MI2003A00112, filed Jan. 24, 2003, all of which are hereby incorporated by reference in their entireties.

TECHNICAL FIELD

The present invention relates to a multiple optical assembly for a LED lighting device, and to a LED lighting device comprising such an optical assembly.

BACKGROUND ART

Of interior lighting devices, standard-size spot lights are widely used, which can be installed in a variety of configurations, and for this reason are of specific shape and size. Typical of these, for example, are MR-16 standard dichroic lights.

Recently, lights of this type have been proposed which, instead of normal quartz-iodine lamps, employ solid-state light sources, in particular light-emitting diodes (LED's). Currently available solutions, however, are not yet fully satisfactory in terms of lighting efficiency and straightforward design. That is, on the one hand, single-LED lights fail to provide for adequate light intensity, whereas, given the limited (standard-imposed) space available, using banks of LED's associated with respective lenses calls for using small, and therefore low-efficiency, lenses.

DISCLOSURE OF INVENTION

It is an object of the present invention to provide an optical assembly and a lighting device designed to eliminate the aforementioned drawbacks of the known state of the art, and which, in particular, are compact, are cheap and easy to produce, and provide for superior performance.

According to the present invention, there are provided a multiple optical assembly and a lighting device, as defined respectively in accompanying Claims 1 and 17, and, as regards auxiliary characteristics, in the dependent Claims.

The multiple optical assembly according to the invention is highly efficient and compact, and can be produced cheaply and easily. Moreover, the optical surfaces, being separate, do not interfere with one another, thus ensuring optimum performance.

The lighting device featuring the multiple optical assembly according to the invention and a number of LED's associated with respective lenses of the multiple optical assembly is in turn extremely compact, cheap and easy to produce, of superior performance, and suitable, among other things, for producing standard-size lights.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
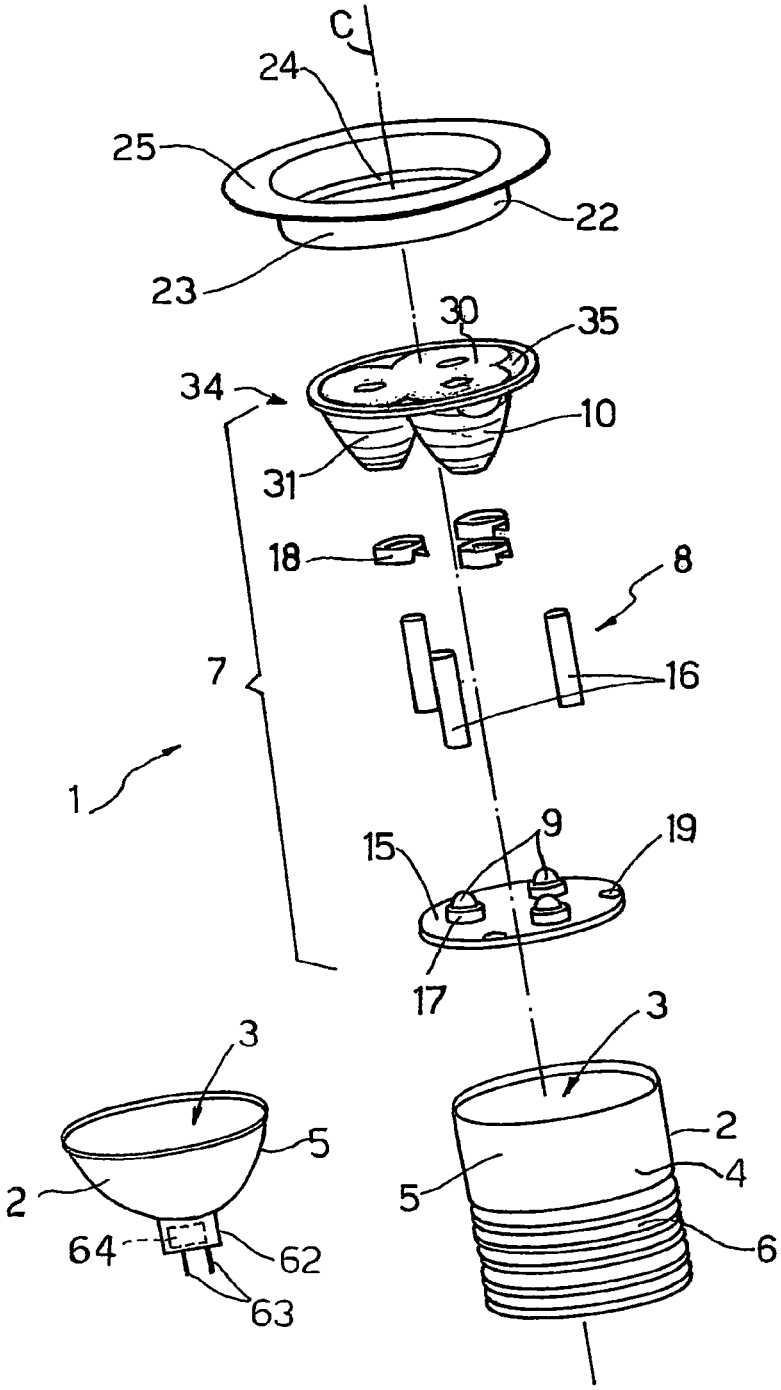
FIG. 1 shows, schematically, an exploded view in perspective of a lighting device featuring a multiple optical assembly in accordance with a first embodiment of the invention.
Figure 2:
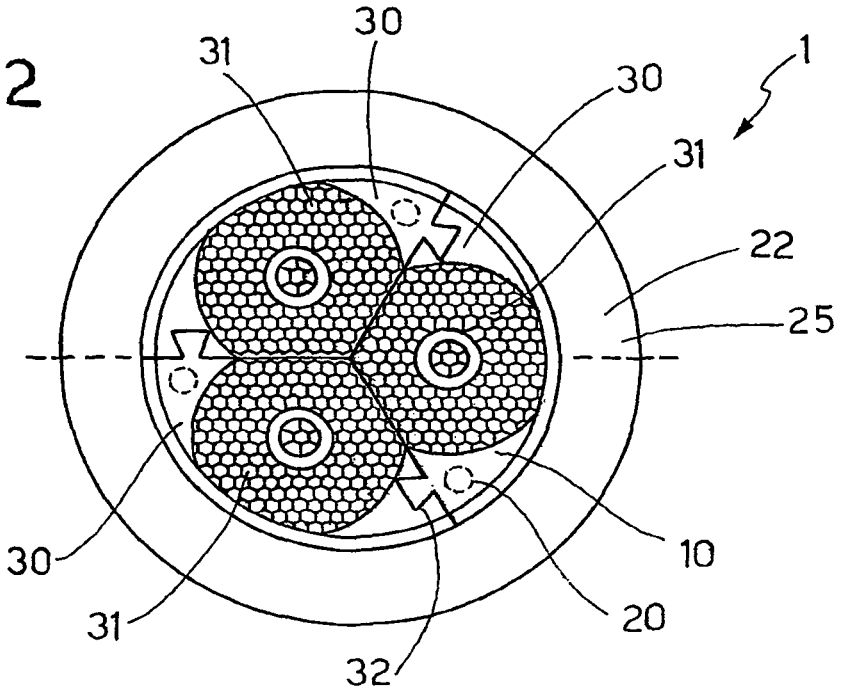
FIG. 2 shows a front view of the FIG. 1 lighting device assembled.
Figure 3:
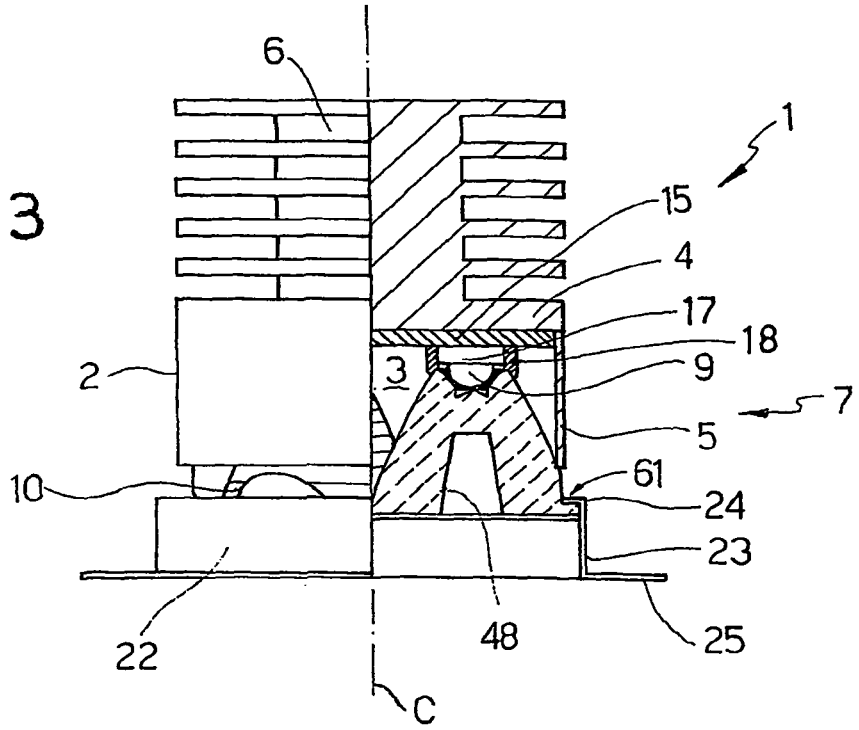
FIG. 3 shows a partly sectioned side view of the FIG. 1 lighting device assembled.

With reference to FIGS. 1 to 3, a LED lighting device 1, usable in particular as an interior spot light, comprises a casing 2 having an inner, e.g. substantially cylindrical, chamber 3 defined by a bottom wall 4 and a lateral wall 5. A heat dissipator 6 projects axially from bottom wall 4, on the opposite side to chamber 3, and comprises, for example, a central column, from which annular fins extend radially. Chamber 3 houses a lighting module 7 comprising a supporting structure 8 supporting a number of LED's 9 (or other similar type of solid-state light sources), and a multiple optical assembly 10 connected mechanically to LED's 9 by supporting structure 8 and designed to convey the light emitted by LED's 9 in a predetermined pattern.

Supporting structure 8 comprises a flat plate 15 fitted with LED's 9 and which rests on bottom wall 4; and connecting members 16 for connecting optical assembly 10 axially and circumferentially to plate 15. In the example shown, three coplanar LED's 9 are provided and arranged in the form of an equilateral triangle. LED's 9 are fitted to respective known mounts 17 fixed in known manner to plate 15 and having respective collars 18 for connection to optical assembly 10; and LED's 9 are connected electrically to an external power source in known manner not shown for the sake of simplicity.

Connecting members 16 are in the form of rods, each rod 16 being inserted and secured with its opposite ends inside respective seats 19, 20 formed in plate 15 and optical assembly 10 respectively. It is understood, however, that optical assembly 10 may be connected mechanically to plate 15 supporting LED's 9 in any manner other than the one described and illustrated purely by way of example.

Lighting device 1 also comprises an assembly ring 22 having a substantially cylindrical annular body 23, in turn having, at opposite axial ends, a radially inner flange 24 for connection to optical assembly 10, and a radially outer flange 25 for connection to an outer member (not shown).

With reference also to FIGS. 4 to 8, optical assembly 10 comprises a number of modular units 30 having respective lenses 31; and coupling means 32, in particular mechanical, e.g. joint, coupling means, for connecting modular units 30 to one another and maintaining lenses 31 in predetermined positions with respect to one another.

In the non-limiting example shown, three identical modular units 30 are provided, each defined by a monolithic piece 33 molded from polymer material and, in plan view, substantially in the form of a sector of a predetermined angle equal to a submultiple of a circle—in the example shown, 120°. The three modular units 30 in the example shown are adjacent to one another and arranged 120° apart about a central axis C along which optical assembly 10 extends. At an axial end 34, optical assembly 10 has a substantially circular peripheral end edge 35.

Figure 7:
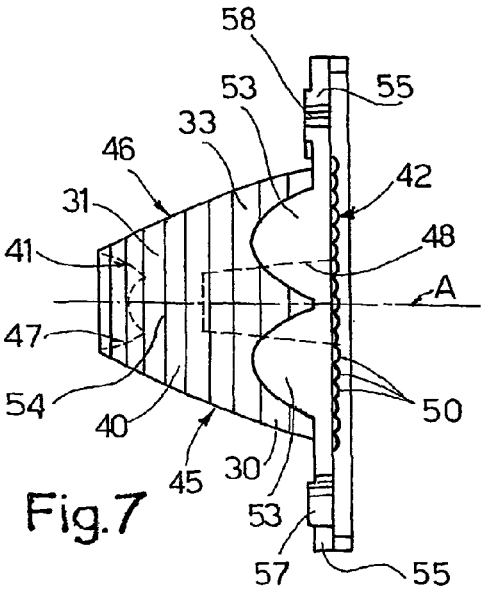
FIGS. 6, 7, 8 show a front view and two perpendicular side views, respectively, of a separate component of the FIGS. 4 and 5 multiple optical assembly.
Figure 6:
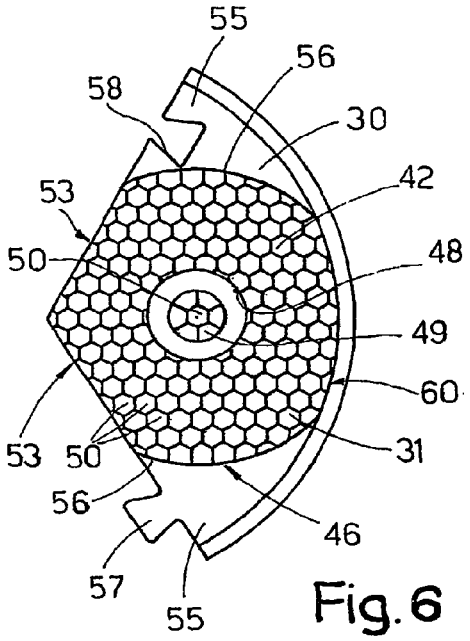
Figure 4:
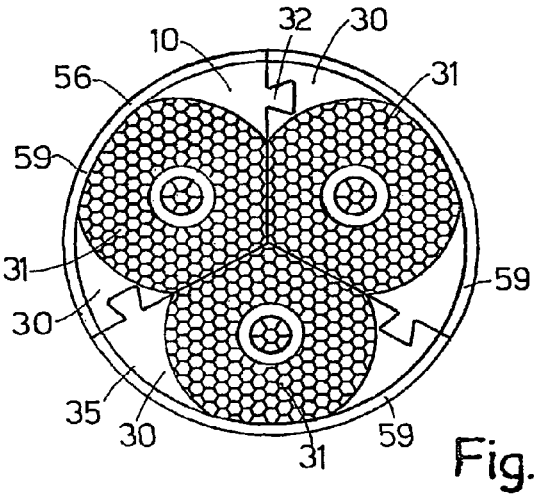
FIGS. 4 and 5 show a front view and a side view, respectively, of the multiple optical assembly of the FIG. 1 lighting device.
Figure 8:
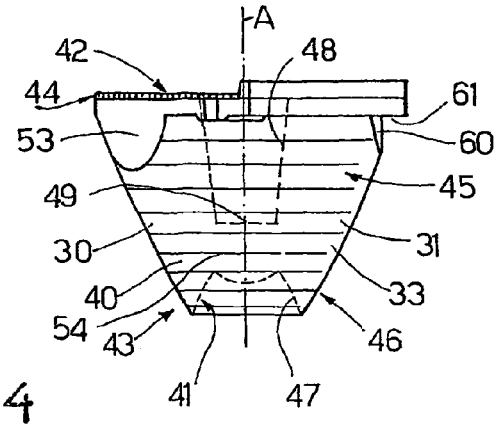
Figure 5:
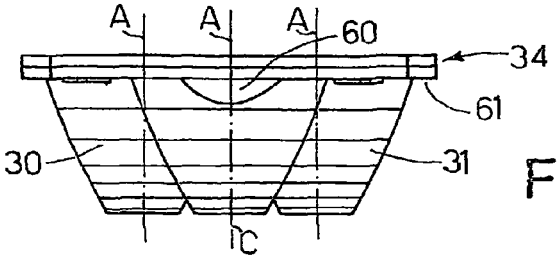

With specific reference to FIGS. 6 to 8, lenses 31 are high-efficiency, total-internal-reflection lenses or collimators, and comprise respective bodies 40 made of transparent polymer material and designed to reflect and transmit light internally. Each lens 31 has an entry surface 41 and an exit surface 42 located at respective opposite axial ends 43, 44 of lens 31; and an optical reflecting surface 45 defined by a curved lateral surface 46 of body 40 located between entry surface 41 and exit surface 42. Optical surfaces 45 are reflecting surfaces for transmitting light internally to each lens 31 between opposite ends 43, 44 of the lens.

In the example shown, though not necessarily, bodies 40 are bodies of revolution, and have respective central axes A defining respective optical axes of lenses 31.

End 43 of each lens 31 has a recess 47 defined by entry surface 41 and housing a LED 9; end 44 of each lens 31 has a dead hole 48, e.g. substantially cylindrical or truncated-cone-shaped, which extends along axis A from exit surface 42 towards end 43 and has a bottom surface 49; and exit surface 42 and bottom surface 49 may have respective numbers of microlenses 50, e.g. concave lenses arranged in a hexagonal pattern.

Hole 48 is aligned with recess 47, and is separated from recess 47 by a partition 54 defining a refraction lens. Though lenses 31 may be defined generally as "total-internal-reflection lenses", in actual fact, each lens 31 therefore comprises a portion, defined by optical surface 45, which is actually internally reflective, and a portion, defined by partition 54, which is refractive.

Curved lateral surfaces 46 of lenses 31 are bevelled so as to comprise respective substantially flat surface portions 53. More specifically, each lens 31 has two bevelled surface portions 53 forming a 120° V; lenses 31 are arranged adjacent and side by side; and the adjacent lenses 31, i.e. lenses 31 of adjacent modular units 30, are arranged with respective surface portions 53 facing and substantially contacting each other, so that lenses 31 have respective distinct optical surfaces 45.

Axes A of lenses 31 are substantially parallel to one another and to central axis C of optical assembly 10.

Each modular unit 30 comprises a lens 31; and two connecting appendixes 55 projecting radially in substantially opposite directions from an edge 56 of lens located at end 44 of lens 31. The connecting appendixes 55 of each modular unit 30 are in the form of flat blades, and have joint elements 57, 58. More specifically, connecting appendixes 55 of each modular unit 30 comprise a tooth 57, e.g. a dovetail tooth, and, respectively, a complementary seat 58, so that the tooth of each modular unit engages the seat of the adjacent modular unit.

In plan view, lenses 31 are inscribed in peripheral end edge 35, which is defined by respective consecutive edge portions 59 of modular units 30. Edges 56 of lenses 31 are cut from peripheral end edge 35, so that optical surface 45 of each lens 31 comprises a peripheral portion 60 which varies in curvature with respect to the overall optical surface 45. The optical surface 45 of each lens 31 is therefore defined by curved lateral surface 46 of respective body 40, by the two bevelled surface portions 53, and by peripheral portion 60 of different curvature.

Peripheral end edge 35 projects radially outwards to define a shoulder 60 cooperating with flange 24 of assembly ring 22.

It is understood that casing 2 may be formed to shapes and sizes compatible with any commercial standard, and in particular to standard MR-16 or similar, as shown schematically, not to scale, to the left in FIG. 1; in which case, casing 2 is substantially bowl-shaped, inner chamber 3 is defined by a curved lateral wall 5, and casing 2 also comprises a connecting block 62 having standard connectors 63 and possibly housing a known unit 64 (only shown schematically) for electronically controlling LED's 9.

In a preferred embodiment, LED's 9 emit in different bands, e.g. corresponding to the three basic colours (red, green, blue) to define an RGB emitting system; in which case, electronic control unit 64 may also be advantageously used to control colour emission of device 1.

Figure 9:
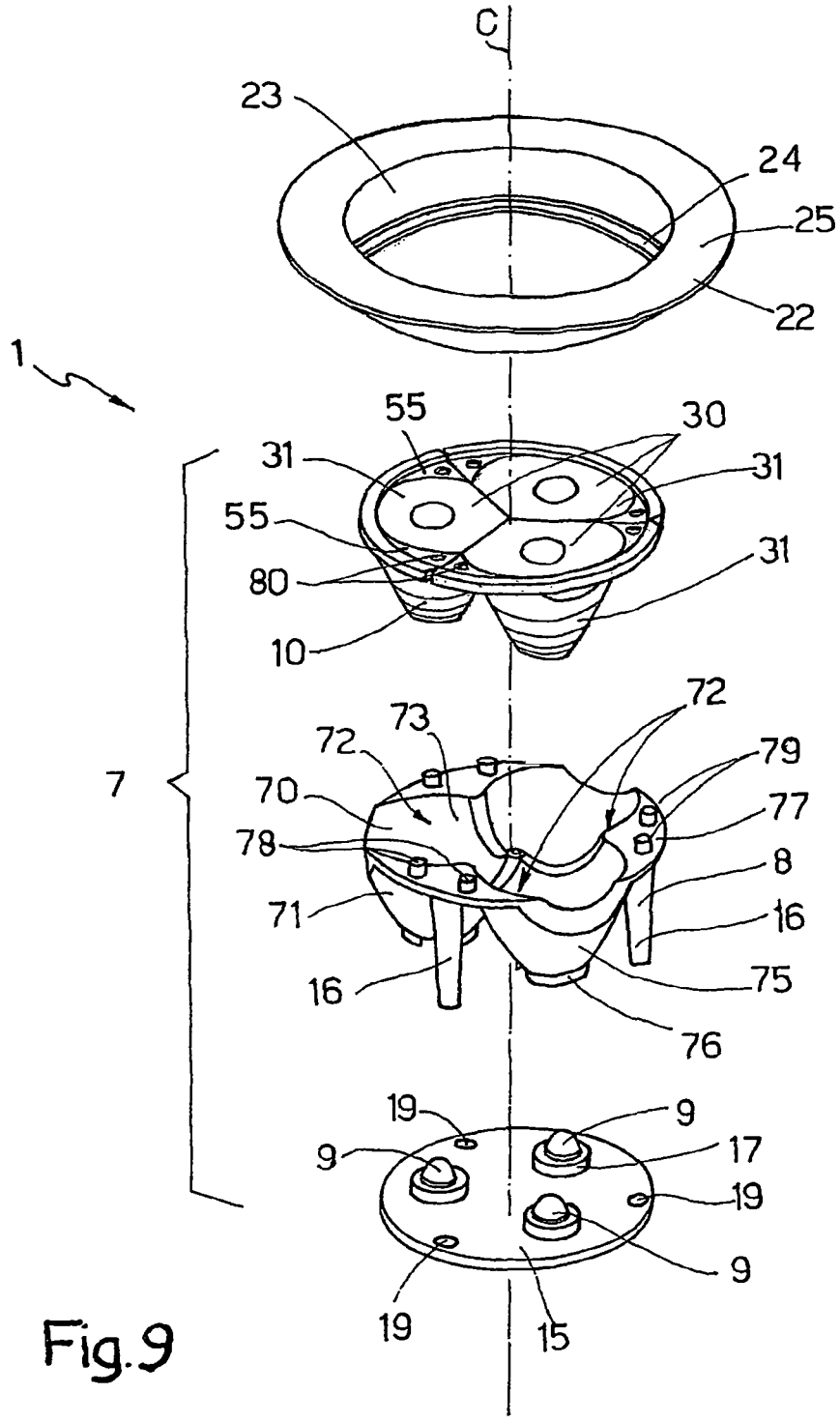
FIG. 9 shows, schematically, an exploded view in perspective of a lighting device featuring a multiple optical assembly in accordance with a second embodiment of the invention.

In the FIG. 9 variation, in which any details similar to or identical with those already described are indicated using the same reference numbers, supporting structure 8 comprises a shell 70 housing modular units 30. Shell 70 extends substantially along axis C, is arranged to cover lenses 31, comprises a hollow monolithic body 71 molded from polymer material, and has seats 72 housing and for maintaining respective lenses 31 in their predetermined positions.

Each seat 72 has an inner lateral surface 73 matching optical surface 45 of lens 31 housed inside seat 72. The inner lateral surface 73 of each seat 72 is arranged to substantially cover optical surface 45 of respective lens 31, and is detached from optical surface 45 by a gap (not shown), which may be formed by the mating clearance of lenses 31 inside seats 72 (if modular units 30 and shell 70 are formed separately and then assembled), or by different shrinkage of the materials from which modular units 30 and shell 70 are molded (if modular units 30 and shell 70 are co-molded or molded one on top of the other from two materials).

Shell 70 comprises three lobes 75 extending parallel to axis C and having respective seats 72. At opposite ends, lobes 75 have respective collars 76 for connection to respective mounts 17, and three connecting portions 77, which join lobes 75 to one another and are fitted with respective projecting rod-shaped connecting members 16 fixed to respective holes 19 formed in plate 15.

Locking members 78 are provided to connect modular units 30 to shell 70 and secure lenses 31 inside respective seats 72. In the example shown, locking members 78 comprise pins 79 projecting axially from connecting portions 77, in the opposite direction to connecting members 16, and which engage respective holes 80 formed in connecting appendixes 55 of modular units 30.

The invention claimed is:

1. A lighting device, comprising:

a lighting module, comprising:

a plate to which a plurality of light emitting diodes (LEDs) is mounted, at least one lens having an entry surface and an exit surface located at respective opposite axial ends thereof and having an optical reflective surface defined by a curved lateral surface located between said entry and exit surfaces, a shell having at least one seat for housing said at least one lens, and a plurality of rods for connecting said shell to the plate, wherein an inner lateral surface of said seat is arranged to substantially cover said curved lateral optical surface of said lens housed in the seat.

2. The lighting device of claim 1, wherein said plate comprises a plurality of holes.

3. The lighting device of claim 2, wherein said shell comprises a plurality of seats for housing a plurality of lenses.

4. The lighting device of claim 3, wherein each of said rods extends between two opposed ends one of which is adapted for insertion in a respective one of said holes in the plate and the other for coupling to said shell.

5. The lighting device of claim 1, wherein said inner lateral surface of said seat matches said curved lateral optical surface of said lens housed inside the seat.

6. The lighting device of claim 1, wherein said inner lateral surface of said seat is detached by a gap from said lateral optical surface of said lens housed inside the seat provided by the shell.

7. The lighting device of claim 1, wherein said shell comprises a hollow monolithic body.

8. The lighting device of claim 1, wherein said shell is formed of a polymeric material.

9. The lighting device of claim 1, wherein said at least one seat of said shell comprises three lobes each of which provides a seat for housing one of three lenses.

10. The lighting device of claim 1, further comprising an assembly ring having a radially inner flange for connection to said shell.

11. The lighting device of claim 1, further comprising a casing for housing said lighting module.

12. The lighting device of claim 11, wherein said casing comprises an inner chamber defined by a bottom wall and a lateral wall.

13. The lighting device of claim 12, further comprising a heat dissipator projecting axially from said bottom wall.

14. A lighting module, comprising:

at least one lens having an entry surface and an exit surface located at respective opposite axial ends thereof and having a curved lateral surface located between said entry and exit surfaces, a shell having at least one seat for housing said at least one lens, and a plurality of rods extending from said shell and adapted for coupling said shell to a plate to which a plurality of light emitting diodes (LEDs) is mounted, wherein an inner lateral surface of said seat is arranged to substantially cover said curved lateral surface of said lens housed in the seat.

15. The lighting module of claim 14, wherein said inner lateral surface of said seat is detached by a gap from said lateral optical surface of said lens housed in the seat provided by said shell.

16. The lighting module of claim 14, wherein said inner lateral surface of said seat matches a said curved lateral optical surface of said lens housed inside the seat.

17. The lighting module of claim 16, wherein said shell comprises a hollow monolithic body.

18. The lighting module of claim 15, wherein each of said rods is adapted for coupling at one end to said shell and for insertion at an opposed end in a respective hole of said plate.

19. The light emitting module of claim 14, wherein said curved lateral surface of the lens comprises a reflective surface.

20. The light emitting module of claim 19, wherein said reflective surface comprises a total internal reflection surface.

21. A lighting module, comprising:

at least one lens having an entry surface and an exit surface located at respective opposite axial ends thereof and having an optical reflective surface defined by a curved lateral surface located between said entry and exit surfaces, a shell having at least one seat for housing said at least one lens, and a plurality of rods extending from said shell and adapted for coupling said shell to a plate to which a plurality of light emitting diodes (LEDs) is mounted, wherein an inner lateral surface of said seat matches said curved lateral optical surface of said lens housed in the seat.

22. The lighting module of claim 21, wherein said inner lateral surface of said seat is detached by a gap from said lateral optical surface of said lens housed in the seat.

23. The lighting module of claim 21, wherein said inner lateral surface of said seat is arranged to substantially cover said curved lateral surface of said lens housed in the seat.

24. The lighting module of claim 21, wherein said lateral reflective surface comprises a total internal reflection reflective surface.

* * * * *